US005509386A

United States Patent [19]

Wallis et al.

[11] Patent Number: 5,509,386

[45] Date of Patent: Apr. 23, 1996

[54] SEALING MEANS FOR ROTARY VALVES

[75] Inventors: Anthony B. Wallis, Gladesville; Andrew D. Thomas, East Ryde, both of Australia

[73] Assignee: A. E. Bishop Research Pty. Limited, North Ryde, Australia

[21] Appl. No.: 424,439

[22] PCT Filed: Nov. 3, 1993

[86] PCT No.: PCT/AU93/00569

§ 371 Date: May 5, 1995

§ 102(e) Date: May 5, 1995

[87] PCT Pub. No.: WO94/11619

PCT Pub. Date: May 26, 1994

[30] Foreign Application Priority Data

Nov. 6, 1992 [AU] Australia ..... PL5729

[51] Int. Cl.[6] ..... F01L 7/00

[52] U.S. Cl. ..... 123/190.17; 123/190.8

[58] Field of Search ..... 123/190.4, 190.6, 123/190.8, 190.1, 190.16, 190.17

[56] References Cited

U.S. PATENT DOCUMENTS

| | | | |
|---|---|---|---|
| 3,871,340 | 3/1975 | Zimmerman | 123/190.17 |
| 4,019,487 | 4/1977 | Guenther | 123/190.17 |
| 4,404,934 | 9/1983 | Asaka et al. | 123/190.8 |
| 4,852,532 | 8/1989 | Bishop | 123/190.17 |
| 5,074,265 | 12/1991 | Ristin et al. | 123/190.8 |
| 5,152,259 | 10/1992 | Bell | 123/190.2 |
| 5,154,147 | 10/1992 | Muroki | 123/190.17 |

*Primary Examiner*—David A. Okonsky

*Attorney, Agent, or Firm*—Nikaido, Marmelstein, Murray & Oram

[57] ABSTRACT

A rotary valve (10) of an internal combustion engine, of the hollow cylindrical type for rotation in the bore (20) of the cylinder head of the engine, the valve (10) having oil and gas seals (17,14) to prevent leakage of oil to the combustion chamber and leakage of gas from the combustion chamber, each gas seal being of the piston ring type and each oil seal consisting of a non-rotating annular member (17), a seal (21) between it and the bore in which the valve (10) rotates, an annular cavity (24) lying peripherally in a small radial clearance between the valve (10) and the bore (20) and extending between the gas sealing ring (14) and the seal (21) on the annular member (17), the annular member (17) having a substantially radially disposed face (18) arranged to seal slidingly against a radially disposed face (19) on the valve (10), the quality of these faces (18,19) being such as to allow migration of oil between them but sufficient when combined with the radial depth of the faces (18,19) to prevent oil from migrating across the entire radial depth during that period of the engine cycle where pressure in the annular cavity (24) is less than the oil pressure in a space (23) at on end of the annular member (17), a spring (22) acting on the one end of the annular member (17) to urge the radial face (18) of the annular member (17) against the radially disposed face (19) on the valve (10).

9 Claims, 7 Drawing Sheets

SEALING MEANS FOR ROTARY VALVES

The present invention relates to an oil sealing means, a gas sealing means, and a decompression means to allow correct operation of the gas sealing means for use in rotary valves of internal combustion engines.

The invention provides a means for sealing lubricant present in bearing areas and, in some cases, lubricant present for cooling purposes from the combustion chamber of a rotary valve internal combustion engine and a means for sealing the axial outflow of gases from the combustion chamber. It is applicable to internal combustion engines of both the two or four stroke varieties. It is relevant to any rotary valve assembly in which the rotary valve is configured so that a central working portion rotates in a housing and is supported on bearings that maintain a small running clearance between the rotary valve and its housing.

The present invention consists in a rotary valve of an internal combustion engine having a cylindrical valve, bearing means at each end of said valve supporting said valve for rotation in abore of the cylinder head of the engine with a small radial clearance between the valve and the bore and means of communication between the combustion chamber and the small radial clearance, oil for lubrication of said bearing means, oil sealing means axially inboard of said bearing means arranged to prevent the axial inward leakage of said oil through the small radial clearance to the combustion chamber, a space between said bearing means and said oil sealing means containing oil, and gas sealing means axially inboard of said oil sealing means arranged to minimise outward axial leakage of gas from the combustion chamber through the small radial clearance, characterised in that each gas sealing means consists of at least one circumferential sealing element of the piston ring type housed in at least one circumferentially extending groove formed either in the periphery of the valve or in the bore of the cylinder head and radially preloaded against the surface of the other, each oil sealing means consisting of a non-rotating annular member also having a small radial clearance to the bore of the cylinder head, second sealing means sealing the small radial clearance between the annular member and the bore, an annular cavity lying peripherally in the small radial clearance and extending between the circumferential sealing element and the second sealing means, the annular member having a substantially radially disposed face arranged to seal slidingly against a radially disposed face on the valve, spring means acting on one end of the annular member to urge the radial face of the annular member against the radially disposed face on the valve.

A preferred form of the present invention also provides a decompression means consisting of means preloading said spring means so that pressure build up in said annular cavity due to flow of high pressure gas from the combustion chamber at the start of the compression stroke can unseat said annular member allowing high pressure gas in said annular cavity to exhaust into said space, said exhausting of high pressure gas causing a collapse of pressure in said annular cavity creating a substantial pressure drop across said circumferential sealing element forcing said sealing element to seat sealingly against the axially outer radial face of said groove.

Another preferred form of the present invention also provides a venting means acting to minimize pressure build up in said annular cavity later in the compression and power strokes, said venting means having sufficient resistance to flow of gas from said annular cavity to ensure maintenance of an average positive pressure gradient between said annular cavity and said space during every engine cycle.

In order that the nature of the invention may be better understood an embodiment thereof is hereinafter described, by way of example, with reference to accompanying drawings in which.

Figure 1:
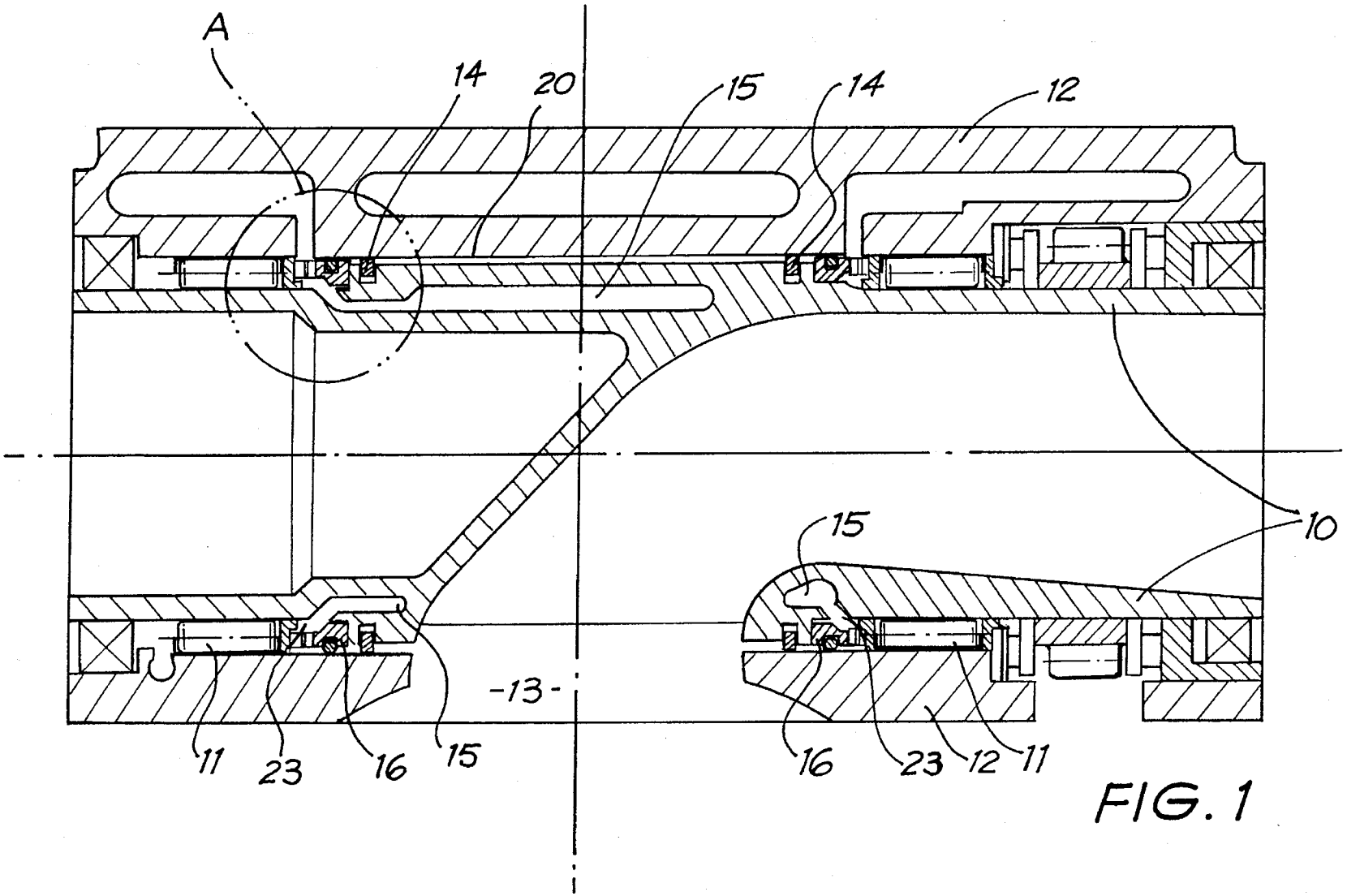
FIG. 1 is a longitudinal cross-sectional view of an embodiment of a rotary valve assembly according to the present invention, positioned in the bore of a cylinder head.

A typical rotary valve assembly incorporating the invention is shown in FIG. 1. Features of construction are included in this figure not related to the present invention and these will not be described.

Rotary valve 10 is supported by two needle roller bearings 11. The central portion of the valve (ie the zone located between the bearings) is designed to rotate whilst always maintaining a small radial clearance to the bore 20 of cylinder head 12. The axial outflow of gases from combustion chamber 13 is prevented by the presence of circumferential sealing elements 14.

Figure 2:
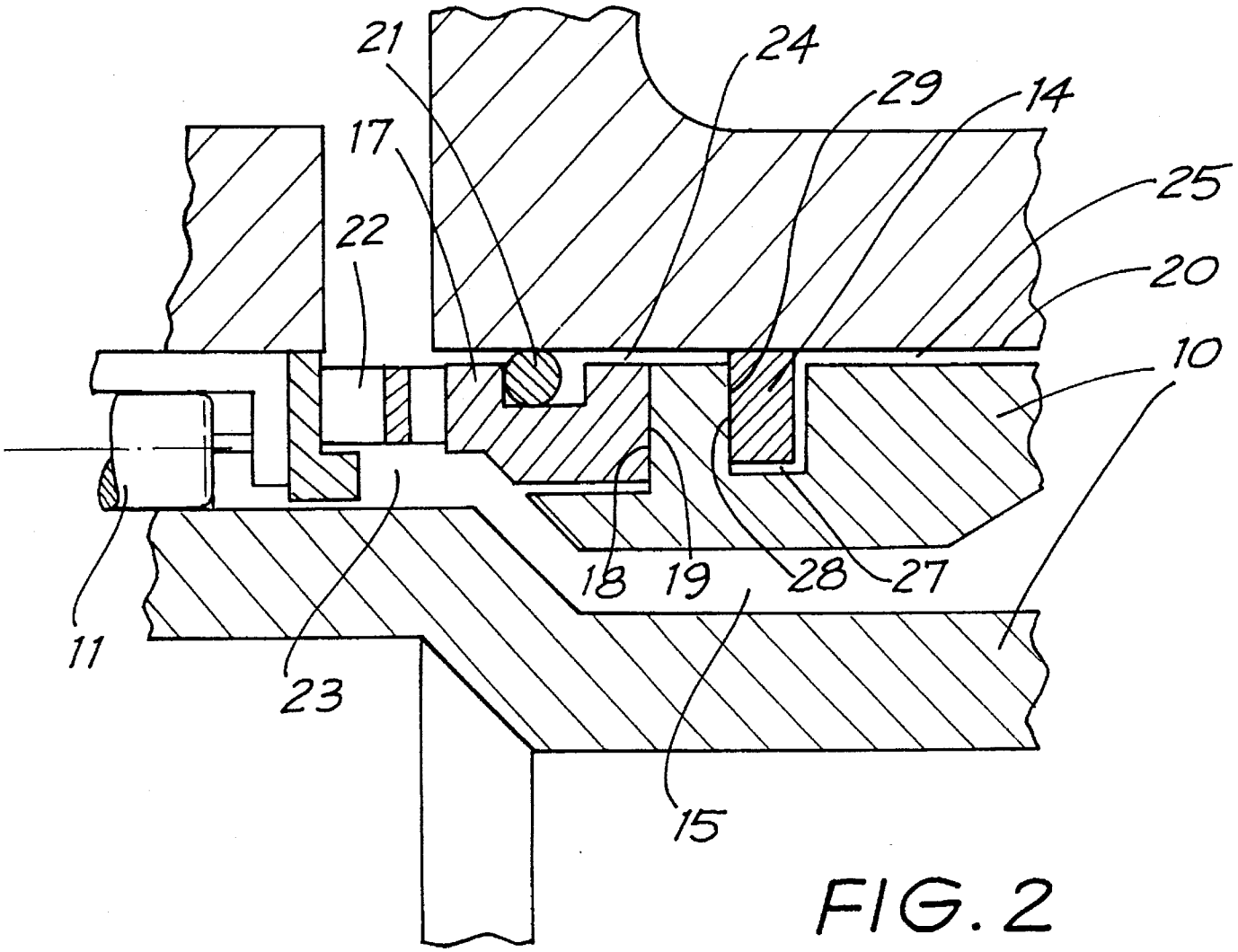
FIG. 2 is a view, to an enlarged scale, of portion A in FIG. 1, showing details of the sealing assembly.

The sealing elements 14 are of the piston ring type and in this instance housed in circumferentially extending grooves 27 (FIG. 2) in the rotary valve and their circumference is preloaded against the bore 20 of cylinder head 12. The sealing elements 14 necessarily have a very small gap between their ends which allows some leakage past the element. This is referred to in the specification as the "ring gap".

The sealing elements 14 have a small axial clearance to their grooves 27. In order for them to seal the axial outflow of gas from the combustion chamber, the sealing elements 14 must be pressed against the axially outer radial surfaces 28 of grooves 27. When this occurs leakage of gas past the sealing elements 14 is restricted to that which can flow through the small area formed by the ring gap and the radial clearance of the periphery of valve 10 to the bore 20 of cylinder head 12.

It is not possible to preload sealing elements 14 against the axially outer radial surfaces 28 of grooves 27 as this prevents the admission of any lubricant between the axially outer radial surfaces 28 of grooves 27 and the axially outer radial surface 29 of sealing element 14. Consequently the seating of sealing element 14 against the axially outer radial surface 28 relies on the build up of a sufficient pressure drop across sealing element 14 to force sealing element 14 axially outward against radial surface 28.

Oil is present in a space 23 between needle roller bearings 11 and sealing assemblies 16 as a means of lubricating roller bearings 11 and of cooling the rotary valve 10 by flowing through cored passages 15 within rotary valve 10.

Oil is prevented from movement into combustion chamber 13 by the presence of sealing assemblies 16. Sealing assembly 16 consists of annular member 17 and "O" ring 21.

Figure 3:
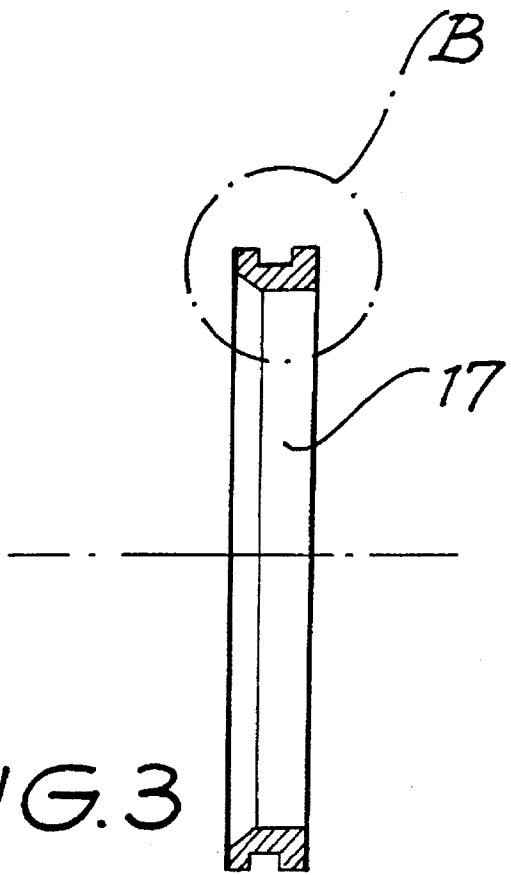
FIG. 3 is a sectional view of an annular member forming part of the sealing assembly.
Figure 4:
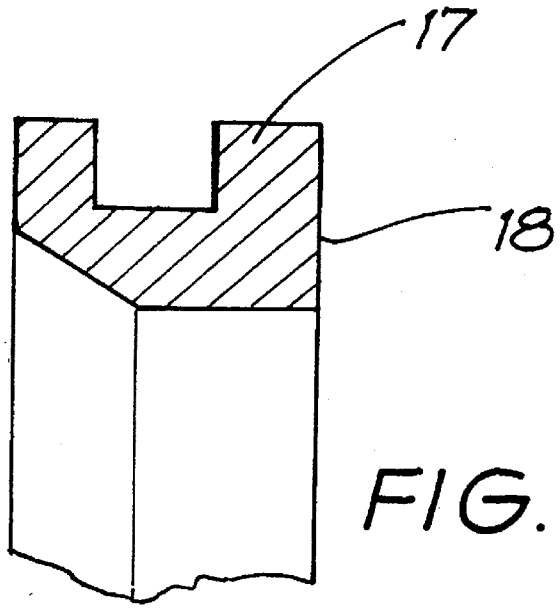
FIG. 4 is a view to an enlarged scale of portion B in FIG. 3.

Each sealing assembly 16 acts as a combination face seal/one way valve. In order for sealing assembly 16 to operate correctly it requires the following five features (see FIG. 2).

a) Annular member 17. Details of annular member 17 are shown in FIGS. 3 and 4. It is an annular ring with a circumferentially extending groove in its periphery and a lapped radial face 18 which seats against valve radial face 19. The annular ring can be made from cast iron or other suitable material. This material must have high stiffness (typical of metals) as the sectional height is limited to that of the needle roller bearings 11 that support the valve, which is typically only 4 mm. In addition as operation of sealing assembly 16 involves the movement of annular member 17 away from valve radial face 19 followed by its return to radial face 19 under the action of wave spring 22 the material must be capable of withstanding impact without local deformation or loss of flatness on radial face 18 of annular member 17. This is a major deviation from face seal practice where it is standard procedure for one of the face seal elements to be carbon. In this application carbon has insufficient stiffness and strength.

b) "O" ring 21.

c) Wave spring 22.

d) Valve radial face 19 on the rotary valve 10, the plane of which is perpendicular to the axis of the valve 10. This face on the valve 10 is a ground face. It is not lapped due to the difficult nature of such an operation on the complete valve 10. This is a major deviation from face seal practice where it is essential for both mating faces to be lapped if satisfactory sealing performance is to be obtained.

e) Space 23 filled with oil arranged so that there is always oil pressure acting on the rear face of sealing assembly 16. The magnitude of the oil pressure is not important so long as it is positive by some magnitude—however small. This space 23 must have provision for the inward and outward flow of the oil contained in it.

Method Of Operation

When the engine is stationary, radial face 18 of annular member 17 is forced into contact with valve radial face 19 by the presence of spring 22. Oil pressure in space 23 is zero. Oil is thus prevented from migrating past these two faces. Leakage of oil past the periphery of annular member 17 is prevented by the presence of "O" ring 21.

When the engine is in operation the situation becomes more complex. As the piston moves up and down in the cylinder on the induction, compression, power and exhaust strokes of the four stroke cycle, a cyclically varying pressure is set up in combustion chamber 13. As rotary valve 10 has radial clearance to bore 20 of cylinder head 12 this pressure is communicated directly to the groove 27 in the valve containing sealing element 14. Depending on how sealing element 14 reacts some or all of this pressure will be communicated to annular cavity 24 between sealing element 14 and "O" ring 21.

Details of operation during these strokes are:

Induction Stroke

During this stroke, the piston moves down the cylinder drawing in air from the inlet tract. A negative pressure varying in magnitude from 20 kPa to 90 kPa is generated depending on the position of the throttle. As there is no preload on sealing element 14 to press it into sealing contact with the valve groove 27 this pressure will be present in annular cavity 24. As the oil pressure in space 23 is positive a pressure gradient exists across radial face 18 which attempts to drive oil from space 23 into annular cavity 24. As both mating faces of this seal are not lapped they will not act as a perfect face seal and a small quantity of oil migration will occur between radial faces 18 and 19 towards annular cavity 24.

Compression Stroke

As the piston starts to rise in the cylinder and the inlet valve closes the pressure in the cylinder starts to rise rapidly. Pressure will likewise rise in cavity 25 adjacent to sealing element 14. Again as the ring is not preloaded against the axially outer radial surface 28 of the groove 27 in which it is housed, gas will flow past sealing element 14 into annular cavity 24 where it will be prevented from further escape by the presence of sealing assembly 16. The subsequent sequence of events is dependant on the initial position of the sealing element 14 in groove 27 at the start of the compression stroke. In the event that the axially outer radial surface 29 of sealing element 14 is a large distance from the axially outer radial surface 28 of the valve groove 27 there will be very little resistance to flow of gas between these surfaces and there will be insufficient pressure drop across the sealing element 14 to urge it into sealing contact with groove 27. Consequently the pressure rise in annular cavity 24 will be very rapid and closely follow that in the combustion chamber 13. As the cylinder pressure continues to rise a stage will be reached where the pressure in annular cavity 24 will be sufficient to compress spring 22 and unseat annular member 17.

The high pressure gas in annular cavity 24 will then escape between radial faces 18 and 19 into the oil in space 23. The resulting sudden collapse of pressure in annular cavity 24 results in a sufficient pressure drop between cavity 25 and annular cavity 24 to force sealing element 14 into sealing contact with the axially outer radial surface 28 on the groove 27 containing it. Air leakage from cavity 25 into annular cavity 24 is now restricted to air that can leak only through-the ring gap in sealing element 14, which being very small, allows only a small quantity to pass.

In the event the axially outer radial surface 29 of sealing element 14 is a small distance from the axially outer radial surface 28 of groove 27.there will be considerable resistance to the flow of gasses between these surfaces and an appreciable pressure drop will develop sufficient to push sealing element 14 into sealing contact with groove 27. Flow into annular cavity 24 will now be restricted to that which can flow through the ring gap and the pressure rise will be relatively slow lagging well behind the pressure rise in the combustion chamber. Despite the low leakage rate, the small volume of annular cavity 24 generally eventually results in the pressure in annular cavity 24 exceeding that necessary to unseat annular member 17. There are some circumstances however in which the rate of gas leakage into annular cavity 24 is sufficiently slow to prevent unseating of annular member 17. For example where the engine is operated at low or zero load, the pressure rise in the combustion chamber is slow and the maximum pressure is generally low. In some circumstances the maximum cylinder pressure may be insufficient to unseat the annular member 17. In others the cylinder pressure may be insufficient to drive enough gas through the ring gap in the time available, to achieve the pressure required to unseat annular member 17.

In an engine it is impossible to control the location of the sealing element 14 relative to the axially outer radial surface 28 of groove 27. The gas sealing, oil sealing arrangement will therefore see a range of behaviours between the two extremes outlined above. It is important to note that in some instances the correct functioning of the sealing element 14 can only be achieved by the unseating of annular member 17. In other instances correct functioning of sealing element 14 can be achieved without unseating of annular member 17, however leakage past the seated sealing element 14 will generally result in sufficient pressure in annular cavity 24 to eventually unseat annular member 17.

Figure 5:
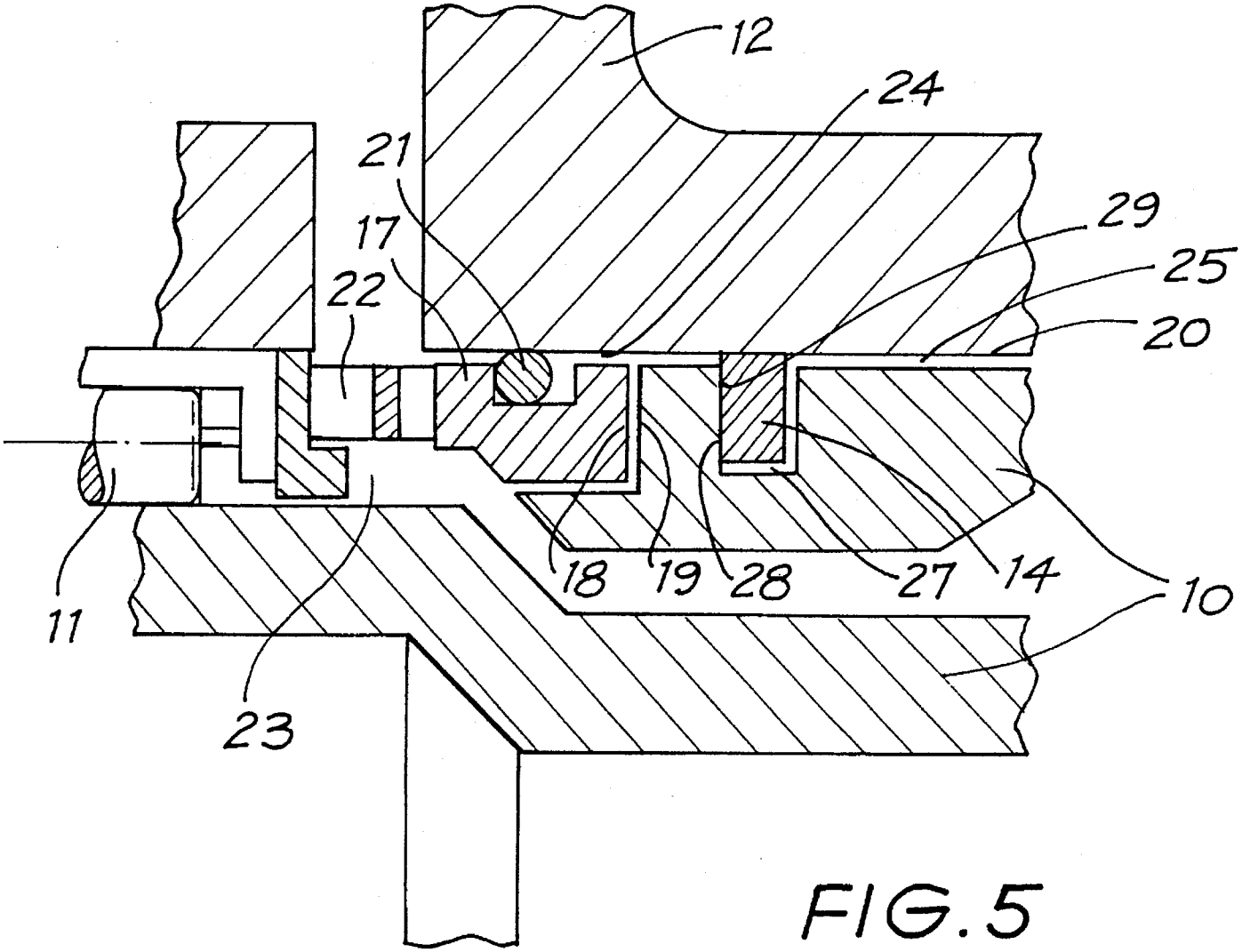
FIG. 5 is a diagrammatic view of a part of the seal assembly to illustrate the operation thereof.

The presence of a space 23 of slightly pressurised oil behind sealing assembly 16 is essential to dissipate energy when annular member 17 is first unseated. Consider the situation shown in FIG. 5. When annular member 17 is seated with radial faces 18 and 19 in contact, the nett force acting to unseat it is the product of the pressure in annular cavity 24 and the area contained between the outer diameter of annular member 17 and the bore 20 of cylinder head 12. Once annular member 17 is lifted off (as shown) the air pressure can now act over the entire radial face 18 of annular member 17. Typically the ratios of these face areas exceeds 100. This results in a very large impulsive force acting to accelerate annular member 17 backward. The presence of the oil around the rear of sealing assembly 16 means that the oil must be displaced outward from space 23 through its connection to cored passage 15, as radial face 18 moves away from mating radial face 19 on the valve. The oil in space 23 thus acts as a shock absorber ie. adding a damping force which is proportional to the axial velocity of annular member 17.

Power Stroke

During the power stroke pressure in the combustion chamber reaches magnitudes up to 1000 psi or even greater depending on throttle setting. In most cases the annular member 17 has been unseated during the compression stroke and the sealing element 14 is seated against the axially outer radial surface 28 of groove 27. A small amount of gas leakage through the ring gap in sealing element 14 maintains a small positive pressure in annular cavity 24. Annular member 17 remains unseated and this air is driven into space 23.

Exhaust Stroke

Once the exhaust valve opens cylinder pressure falls rapidly and annular member 17 is reseated against valve radial face 19 by means of spring 22.

From the above it is apparent that during any engine cycle annular cavity 24 is subjected to an oscillating gas pressure, generally negative during the induction stroke, positive during the compression and power strokes. In addition pressurised oil is present in space 23. Thus during some portions of the cycle (e.g. induction) a negative pressure gradient exists between annular cavity 24 and space 23 which serves to force oil to migrate between radial faces 18 and 19 towards annular cavity 24. During other portions of the cycle (e.g. compression and power strokes) a positive pressure gradient exists between annular cavity 24 and space 23 serving to force the gas in annular cavity 24 between radial faces 18 and 19 towards space 23. The movement of gas from annular cavity 24 towards space 23 pushes ahead of it any oil resident between radial faces 18 and 19.

Thus in any engine cycle a series of events occurs where during a portion of the cycle oil migrates between radial faces 18 and 19 towards annular cavity 24 only to be pushed back towards space 23 by events later in the cycle. Oil will never be able to reach annular cavity 24 as long as two conditions are maintained.

i) The average pressure gradient between annular cavity 24 and space 23 over every engine cycle is positive ii) The quality of radial faces 18 and 19 together with their radial depth, is sufficient to prevent migration of oil across the entire radial depth during any portion of the cycle where the cylinder pressure is negative.

In the constructions shown in FIGS. 1, 2, 5 and 6 condition 1 will always be satisfied. This is a result of the fact that the induction stroke occupies only a quarter of the cycle time and has pressures limited to a minimum of minus 100 kPa. The compression and power strokes occupy half the cycle time and generate pressures of 500 kPa plus.

In the mechanism depicted in FIGS. 1, 2, 5 and 6 it has been stated that the annular member 17 is generally (although not always) unseated during every engine cycle. The unseating of annular member 17 is a special case of the mechanism described above. Once the annular member 17 is unseated the large positive pressure gradient between annular cavity 24 and space 23 results in a rapid outflow of the gas from annular cavity 24 to space 23. The outflowing gas carries before it any oil resident on radial faces 18 and 19. The same mechanism operates if the annular member 17 remains seated. However the rate at which gas from annular cavity 24 can flow into space 23 is severely limited by virtue of the small flow area available and the requirement to push the oil sandwiched between radial faces 18 and 19 ahead of it. The close proximity of radial faces 18 and 19 to one another generates large viscous and capillary forces in the oil apposing the outward flow of the gas.

On some engine types the gas consists of a mixture of air and fuel premixed in the inlet manifold. When the annular member 17 is unseated a small fraction of this air/fuel mixture escapes into space 23 where it mixes with the oil present in space 23. This is a similar situation to that occurring in the cylinder where air/fuel mixture leaks past the piston rings into the crankcase during the compression and power strokes. They are then vented from the crank case back to the induction system and from there back into the engine.

In the latter process a very small proportion of the fuel becomes combined with the oil and is not returned to the induction system. The resulting increase in volume of oil would be a problem except that its magnitude is generally small enough to offset the oil that is lost into the combustion chamber past the rings and down past the valve stems.

There is however one big difference between this process and the one occurring with the rotary valve. In the case of gas escaping past the piston rings they expand into a volume occupied largely by air. In the case of the rotary valve they expand into a volume entirely occupied by oil. It has been found that in these circumstances the fuel is more readily absorbed into the oil. Consequently it is possible for the volume of this oil/fuel mixture to increase faster than the rate of oil consumption which creates a problem of apparent increase in the volume of oil held in the sump.

In engines which have air and fuel premixed prior to entry to the cylinder, it is desirable to minimise the rate at which fuel mixes with the oil. This is best achieved by minimising the number of times the annular member 17 is unseated and/or the length of time annular member 17 is unseated. This could be achieved by providing a large hole connecting annular cavity 24 to a region at or near atmospheric pressure. Leakage past sealing element 14 could then be exhausted to atmosphere without any significant pressure rise in annular cavity 24.

However such a solution would not allow condition 1 (ie the requirement to have an average positive pressure gradient between annular cavity 24 and space 23 during any engine cycle) to be satisfied. Oil leakage from space 23 to annular cavity 24 would then occur.

Figure 7:
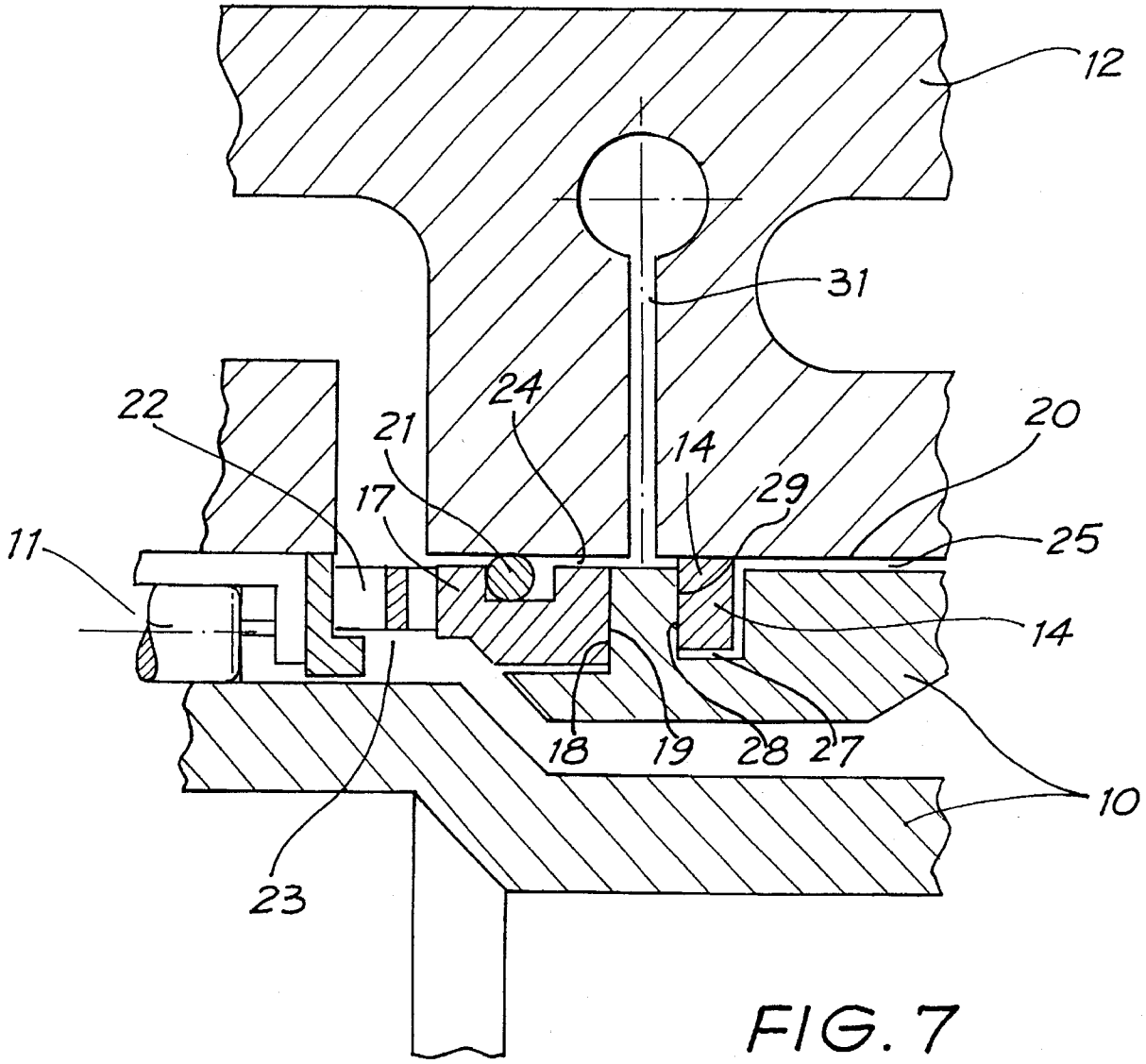
FIG. 7 is a view similar to FIG. 5 showing a modification of the construction shown in FIG. 5.

If however a vent passage 31 of very small cross sectional area was used to connect annular cavity 24 to a region at atmospheric pressure an appreciable pressure drop across the vent passage 31 would be developed and condition 1 could be satisfied by suitable selection of vent passage cross-sectional area. Such an arrangement is shown in FIG. 7. Vent passage 31 has been sized to ensure that even under the most adverse operating condition an average positive pressure gradient is maintained between annular cavity 24 an space 23. This does not ensure that annular member 17 will not be unseated, rather it minimizes the frequency of unseating.

The most adverse operating condition with respect to maintaining an average positive pressure gradient between annular cavity 24 and space 23 occurs when i) the engine load and throttle settings are low, and ii) the axially outer radial surface 29 of sealing element 14 is in close proximity to the axially outer radial surface 28 of groove 27 at the beginning of the compression stroke. Sealing element 14 immediately seats against the axially outer radial surface 28 of groove 27 and gas flow into annular cavity 24 is restricted to that which can flow through the ring gap. The size of vent passage 31 is chosen such that an outflow of gas roughly matching the inflow through the ring gap maintains an adequate pressure in annular cavity 24.

If on the other hand the engine load and throttle settings are high and the axially outer radial face 29 of sealing element 14 is some distance from the axially outer radial face 28 of groove 27 at the beginning of the compression stroke the mass flow rate into annular cavity 24 will be many times greater than in the above case. The resulting large pressure build up in annular cavity 24 will cause the annular member 17 to unseat.

The frequency with which annular member 17 unseats and releases the air/fuel mixture into the oil in space 23 will therefore be a function of the flow restriction of the vent passage 31 and the engine operating conditions.

In addition to the vent passage other modifications will sometimes be necessary. By virtue of the very small radial clearance that exists between the periphery of the valve 10 and the bore 20 of cylinder head 12 the flow area available at the entry to the vent passage 31 may be smaller than that of the vent passage itself. For example:

If the radial clearance is 0.1mm and the vent passage diameter is 1.00 mm, then the entry area available to the vent passage 31 is only 38% that of the cross-sectional area of the vent passage 31. This problem can be overcome by locating vent passage 31 in the zone between the axially outer radial surface 28 of groove 27 and valve radial face 19 by grinding a flat onto the outer diameter of the valve located between the axially outer radial surface 28 and the valve radial face 19. Its angular location is such as to ensure that it is aligned with the vent passage 31 during that portion of the cycle when the maximum mass flow from the annular cavity 24 is required.

Indeed the effectiveness of this method can be appreciably increased by suitably profile grinding the periphery of the valve between the axially outer radial surface 28 of groove 27 and the valve radial face 19 to control the effective flow area of the vent passage 31 as a function of the valve position. For example early in the compression stroke the cylinder pressures are small and the density of air in the ring gap of sealing element 14 is low. Mass flow rates into annular cavity 24 are therefore low and the relatively large area of the vent passage 31 means that pressure in the annular cavity 24 rises slowly. If during this period there is no relief on the periphery of the valve 10 the effective flow area is reduced to 38% of that of the vent passage 31. Pressure rise in annular cavity 24 will therefore be considerably faster. As the object is to maintain a net average positive pressure during the cycle this is highly desirable.

The valve is relieved such that from early in the compression stroke the radial clearance is increased from the standard clearance to a maximum at maximum cylinder pressure (where the mass flow rate into annular cavity 24 is a maximum). At the point of maximum cylinder pressure the vent passage's entry is thus unobstructed and the full vent passage cross-sectional area can be used to exhaust the gases entering annular cavity 24. As the object is to prevent the pressure in annular cavity 24 exceeding that required to unseat the annular ring 17 it is highly desirably to maximise the flow area available at the point of maximum cylinder pressure to minimise the pressure build up in annular cavity 24.

Figure 8:
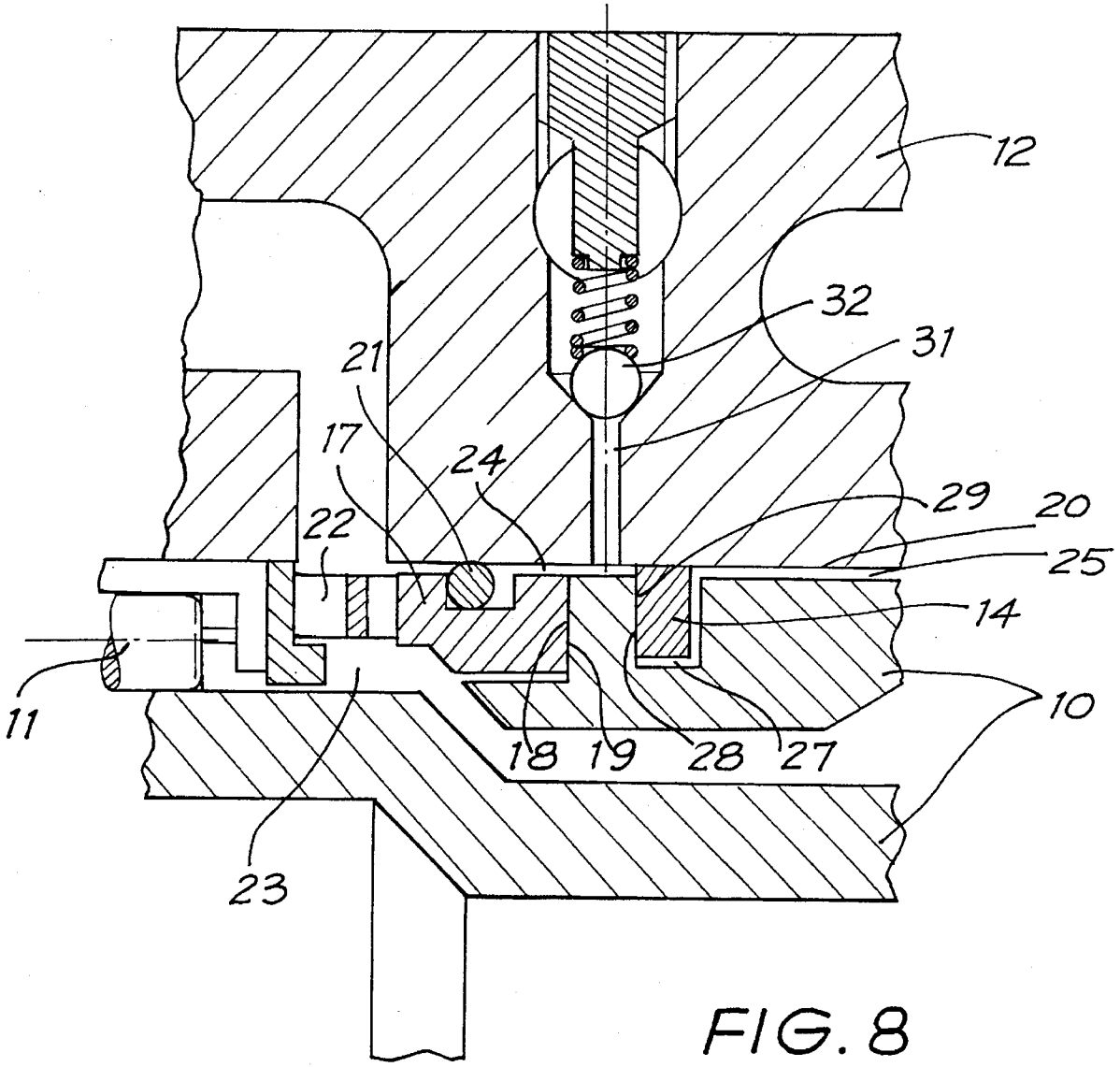
FIG. 8 is a view similar to FIG. 7 showing a modification of the construction shown in FIG. 7.

An alternative means of reducing the frequency of the unseating of the annular member 17 is shown in FIG. 8. This involves the use of a vent passage 31 as discussed above. A pressure relief valve 32 is fitted at the exit of the vent passage 31. The vent passage size is chosen to ensure that the pressure in annular cavity 24 will never exceed that required to lift annular member 17 off its seat. The pressure relief valve is set to ensure it opens at some pressure below that required to lift annular member 17 off its seat.

Tuning the System

As annular cavity 24 is pressurised over most of the compression and power strokes spring 22 must be capable of reseating annular member 17 within the duration of the exhaust stroke. It must be capable of overcoming the inertia of the annular member 17 and the resistance offered by "O" ring 21. Experience has indicated that the spring force required is in the order of 5 kg.

As the radial clearance of the outside diameter of annular member 17 to the bore 20 of cylinder head 12 is generally kept very small the nett area on which the gas pressure can act to unseat annular member 17 is very small. Hence the pressure required to unseat radial annular member 17 is large.

Figure 6:
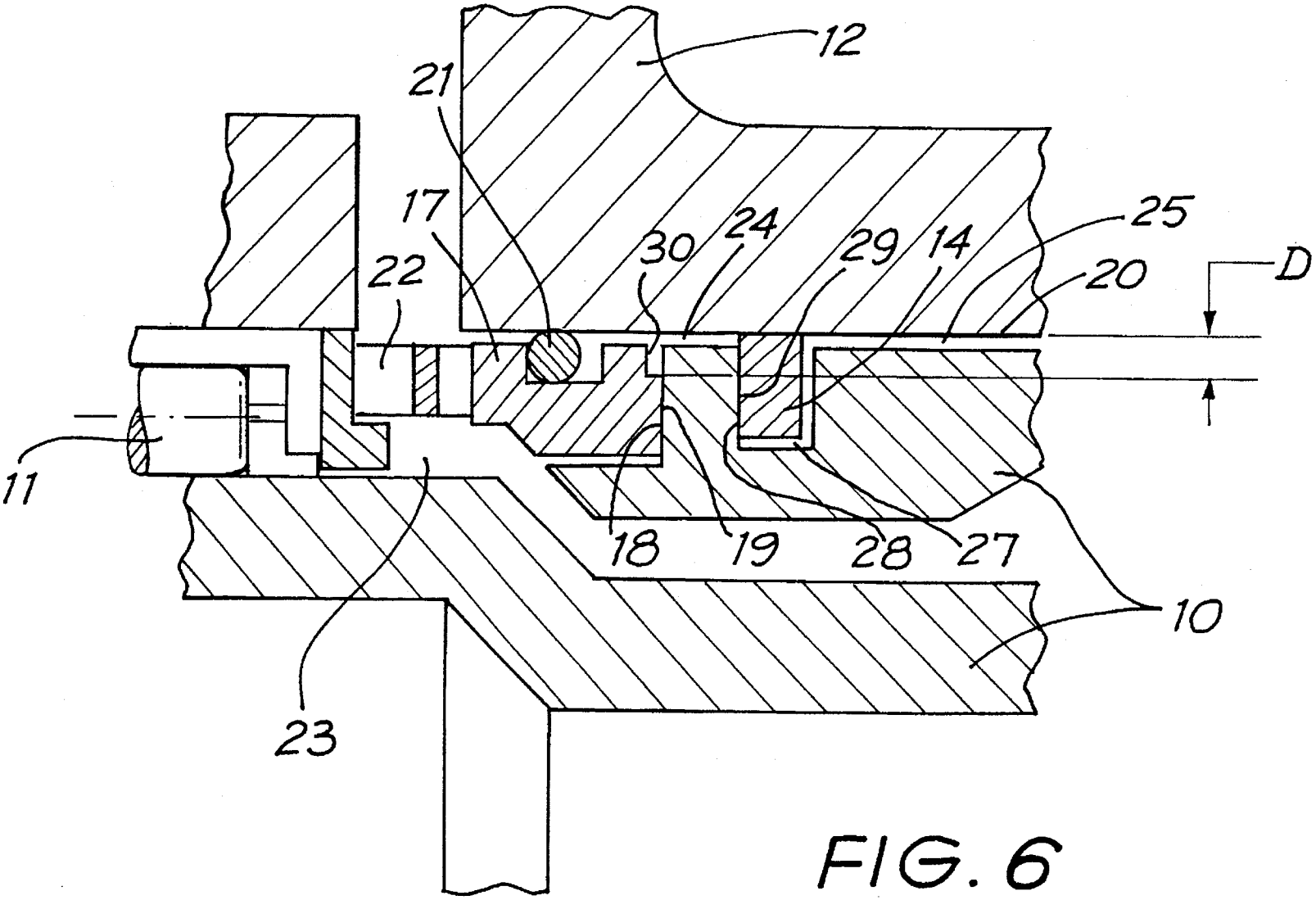
FIG. 6 is a diagrammatic view of a portion of the sealing assembly illustrating a means of controlling its operation.

As there is a certain proportion of engine cycles where sealing element 14 can only seat effectively after the annular member 17 is unseated and releases the pressure in annular cavity 24 a small amount of gas leakage is incurred prior to the sealing element 14 seating. The magnitude of this loss is proportional to the volume of annular cavity 24 and the pressure to which the contents of annular cavity 24 rise prior to the unseating of annular member 17. It is thus desirable to minimise both the cavity size and the pressure required to unseat annular member 17. The pressure required to unseat annular member 17 can be controlled by a step 30 in its radial face 18 as depicted in FIG. 6. By varying the radial depth D, the pressure required to unseat annular member 17 can be regulated to what ever magnitude is desired.

It will be appreciated by persons skilled in the art that numerous variations and/or modifications may be made to the invention as shown in the specific embodiments without departing from the spirit or scope of the invention as broadly claimed. The present embodiments are, therefore, to be considered in all respects as illustrative and not restrictive.

We claim:

1. A rotary valve of an internal combustion engine having a cylindrical valve, bearing means at each end of said valve supporting said valve for rotation in a bore of the cylinder head of the engine with a small radial clearance between the valve and the bore and means of communication between the combustion chamber and the small radial clearance, oil for lubrication of said bearing means, oil sealing means axially inboard of said bearing means arranged to prevent the axial inward leakage of said oil through the small radial clearance to the combustion chamber, a space between said bearing means and said oil sealing means containing oil, and gas sealing means axially inboard of said oil sealing means arranged to minimise outward axial leakage of gas from the combustion chamber through the small radial clearance, characterised in that each gas sealing means consists of at least one circumferential sealing element of the piston ring type housed in at least one circumferentially extending groove formed either in the periphery of the valve or in the bore of the cylinder head and radially preloaded against the surface of the other, each oil sealing means consisting of a non-rotating annular member also having a small radial clearance to the bore of the cylinder head, second sealing means sealing the small radial clearance between the annular member and the bore, an annular cavity lying peripherally in the small radial clearance and extending between the circumferential sealing element and the second sealing means, the annular member having a substantially radially disposed face arranged to seal slidingly against a radially disposed face on the valve, spring means acting on one end of the annular member to urge the radial face of the annular member against the radially disposed face on the valve.

2. A rotary valve as claimed in claim 1 wherein the quality of at least one said face is such as to allow migration of oil between said faces but sufficient when combined with the radial depth of said radial face to prevent oil migrating across the entire radial depth during that period of the engine cycle when pressure in said annular cavity is less than the oil pressure in said space.

3. A rotary valve as claimed in claim 1 wherein at least one said circumferential sealing element is housed in a circumferentially extending groove formed in the periphery of the valve and radially preloaded against the bore of the cylinder head.

4. A rotary valve as claimed in claim 1 wherein at least one said circumferential sealing element is housed in a circumferentially extending groove formed in the bore of the cylinder head and radially preloaded against the periphery of the valve.

5. A rotary valve as claimed in claim 1 wherein said second sealing means consists of an "O" ring or annular sealing element housed in a second circumferentially extending groove formed in the periphery of said annular member.

6. A rotary valve as claimed in claim 1 wherein there is at least one vent passage of relatively small area connecting at least one said annular cavity to a region at or near atmospheric pressure.

7. A rotary valve as claimed in claim 6 wherein a pressure relief valve is located in or at an outer end of at least one said vent passage.

8. A rotary valve as claimed in claim 6 wherein at least one said vent passage extends from a position located axially between the axially outermost radial face of the circumferentially extending groove and the radially disposed face on the valve, that part of the outer periphery of the valve located axially between the said faces being profiled in such a manner that the radial clearance over that part between the periphery of the valve and the bore varies.

9. A rotary valve as claimed in claim 8 wherein the clearance is least when the valve is in a position corresponding to the start of compression in the cylinder and greatest when the valve is in a position corresponding to the maximum cylinder pressure.

* * * * *